US012558587B2

(12) United States Patent
Xu et al.

(10) Patent No.: US 12,558,587 B2
(45) Date of Patent: Feb. 24, 2026

(54) BARBELL CLAMP

(71) Applicant: Nantong Sairui Electronic Technology Co., Ltd., Nantong (CN)

(72) Inventors: Bowen Xu, Nantong (CN); Haibing Xu, Nantong (CN)

( * ) Notice: Subject to any disclaimer, the term of this patent is extended or adjusted under 35 U.S.C. 154(b) by 85 days.

(21) Appl. No.: 18/772,874

(22) Filed: Jul. 15, 2024

(65) Prior Publication Data

US 2025/0303222 A1 Oct. 2, 2025

(30) Foreign Application Priority Data

Mar. 29, 2024 (CN) ..... 202420637973.5

(51) Int. Cl.
*A63B 21/072* (2006.01)

(52) U.S. Cl.
CPC ..... *A63B 21/0728* (2013.01); *A63B 21/0724* (2013.01)

(58) Field of Classification Search
CPC .. A63B 21/0728; A63B 21/0724; A63B 21/07
See application file for complete search history.

(56) References Cited

U.S. PATENT DOCUMENTS 3,771,785 A * 11/1973 Speyer ..... A63B 21/0728 403/375
3,825,253 A * 7/1974 Speyer ..... A63B 21/0728 482/106
4,773,641 A * 9/1988 Metz ..... A63B 21/0728 403/372
8,142,335 B1 * 3/2012 Leach ..... A63B 71/0036 482/49
10,107,317 B1 * 10/2018 Brasch ..... A63B 21/0783
2008/0287271 A1 * 11/2008 Jones ..... F16B 2/10 482/107
2016/0375295 A1 * 12/2016 Brasch ..... A63B 21/0728 482/107
2017/0021223 A1 * 1/2017 Ramsey ..... A63B 21/026
2020/0188723 A1 * 6/2020 Reibman ..... A63B 21/0724
2021/0001165 A1 * 1/2021 Stilson ..... A63B 21/0728
2023/0330472 A1 * 10/2023 Zhang ..... A63B 21/0728
2024/0316390 A1 * 9/2024 Yazdanshenas .... A63B 21/0724
2024/0350855 A1 * 10/2024 Yazdanshenas .... A63B 21/0728
2024/0350856 A1 * 10/2024 Yazdanshenas .... A63B 21/0728

* cited by examiner

*Primary Examiner* — Garrett K Atkinson

(57) ABSTRACT

A barbell clamp comprises a first sleeve that is sleeved on one end of a barbell bar and a second sleeve that is sleeved outside the first sleeve, the first sleeve gradually decreases in inner and outer diameters from its first end to its second end, an outer wall of the first sleeve is an inclined surface, an inner wall of the second sleeve is in contact with the inclined surface, a limiting assembly is installed on an inner wall of the first sleeve, the limiting assembly limits the position after the barbell bar is properly inserted into the first sleeve, a collar is fixedly mounted on an outer end of the first sleeve, an outer surface of the collar is matched with an outer surface of a weight plate, which can effectively prevent the barbell from sliding off.

5 Claims, 3 Drawing Sheets

BARBELL CLAMP

1. TECHNICAL FIELD

The invention relates to the technical field of fitness equipment, in particular to a barbell clamp.

2. BACKGROUND ART

A barbell is a type of sports equipment that requires clamps to secure the weight plates during use to prevent them from coming loose. There are two main types of barbell clamps used in competitions: Olympic-style (or half-nut locking) and spiral-opening type. The former consists of a clamp body (threaded), half-blocks, butterfly nuts, and star nuts, used for smooth bars; the latter consists of a clamp body and pressing blocks, used for threaded rods. The Olympic-style barbell clamp is one of the earliest types of barbell clamps, featuring satisfactory structures, locking performance, and usability; however, its assembly and disassembly cannot be very fast. Therefore, the spiral-opening barbell clamp is invented, this design incorporates two symmetrical pressing blocks, within the collar body; when used with a threaded rod, these pressing blocks are embedded in the threads to provide locking function; however, due to the force applied along the axis of the barbell's horizontal bar, this type of clamp suffers from problems such as poor locking performance and difficulty in opening.

3. SUMMARY OF THE INVENTION

The invention aims to provide a barbell clamp that can effectively prevent the barbell from sliding off.

The barbell clamp provided by the invention comprise a first sleeve that is sleeved on one end of a barbell bar and a second sleeve that is sleeved outside the first sleeve, the first sleeve gradually decreases in inner and outer diameters from its first end to its second end, an outer wall of the first sleeve is an inclined surface, an inner wall of the second sleeve is in contact with the inclined surface, a limiting assembly is installed on an inner wall of the first sleeve, the limiting assembly limits the position after the barbell bar is properly inserted into the first sleeve, a collar is fixedly mounted on an outer end of the first sleeve, an outer surface of the collar is matched with an outer surface of a weight plate.

In practical use, after the weight plate is sleeved on the barbell bar, one side of the first sleeve with a smaller inner diameter is aligned with the barbell bar, so that the barbell bar is slowly inserted into the first sleeve; once inserted to a certain extent, the limiting device will limit the barbell bar to prevent the weight plate from sliding off. After the weight plate is in place, the collar comes into direct contact with the weight plate, the collar has a resistance effect on the weight plate; simultaneously, the outer surface of the collar is designed to match the outer surface of the weight plate, further enhancing the resistance effect on the weight plate.

Further, the limiting assembly comprises multiple limiting spheres, and the inner wall of the first sleeve is radially provided with multiple channels for the sliding of the corresponding limiting spheres, the channels penetrate through both the inner and outer walls of the first sleeve.

Further, the limiting spheres protrude partially outside the channels; after the barbell bar is inserted into the first sleeve, the limiting spheres are respectively contact with the barbell bar and the inner wall of the second sleeve.

Specifically, one end of the first sleeve with a smaller inner diameter is aligned with the barbell bar, the barbell bar is inserted inward; by manipulating the second sleeve to slide relative to the first sleeve, so that the limiting spheres are retracted into the channels, allowing continuous insertion of the barbell bar inward; after inserted into the specified position, with the first sleeve against the barbell bar, and after the barbell bar is fully inserted, due to the first sleeve gradually decreases in inner and outer diameters from its first end to its second end, that is, inner and outer walls of the first sleeve are inclined surfaces, the limiting spheres will be pressed simultaneously by the barbell bar and the inner wall of the second sleeve, the limiting spheres will exert a counterforce on the barbell bar to further secure the barbell bar in place; when disassembly is required, the inner wall of the second sleeve only needs to be slid along the tapered surface of the outer wall of the first sleeve towards one end of a smaller outer diameter of the first sleeve, this will increase the distances between the limiting spheres and an outer wall of the second sleeve, thereby releasing the pressure on the barbell bar and allowing for disassembly.

Further, a hand-held portion is arranged on the outer circumference of the first end of the first sleeve.

Further, the second sleeve is connected correspondingly to the hand-held portion.

4. BRIEF DESCRIPTION OF ACCOMPANY DRAWINGS

As shown in the figures: 1 first sleeve, 2 second sleeve, 3 limiting sphere, 4 hand-held portion, 5 collar, 6 annular sheet.

5. SPECIFIC EMBODIMENT OF THE INVENTION

In order to make the personnel in this technical field better understand the technical scheme, the technical schemes in the embodiments of the invention will be clearly and completely described in combination with the accompanying drawings in the embodiments of the invention. Obviously, the described embodiments are only some of the embodiments of the invention, but not all of the embodiments. Based on the embodiments in this invention, all other embodiments obtained by those of ordinary skill in the art without making creative efforts shall fall within the protection scope of this invention.

Figure 1:
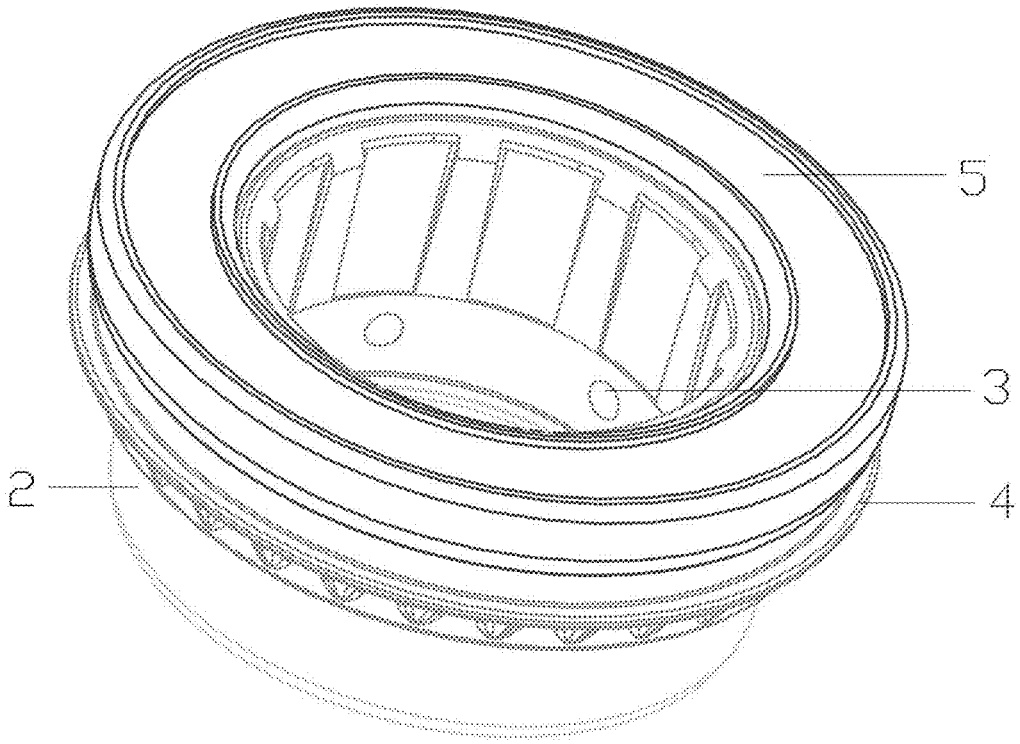
FIG. 1 is a schematic diagram of the structure of the barbell clamp in the embodiment of the invention.

Referring to FIG. 1, the invention shows a barbell clamp, comprising a first sleeve 1 that is sleeved on one end of a barbell bar and a second sleeve 2 that is sleeved outside the first sleeve 1, the first sleeve 1 gradually decreases in inner and outer diameters from its first end to its second end, an outer wall of the first sleeve 1 is an inclined surface, an inner wall of the second sleeve 2 is in contact with the inclined surface, a limiting assembly is installed on an inner wall of the first sleeve 1, the limiting assembly limits the position after the barbell bar is properly inserted into the first sleeve 1, a collar 5 is fixedly mounted on an outer end of the first sleeve 1, an outer surface of the collar 5 is matched with an outer surface of a weight plate.

In practical use, after the weight plate is sleeved on the barbell bar, one side of the first sleeve 1 with a smaller inner diameter is aligned with the barbell bar, so that the barbell bar is slowly inserted into the first sleeve 1; once inserted to a certain extent, the limiting device will limit the barbell bar to prevent the weight plate from sliding off. After the weight plate is in place, the collar 5 comes into direct contact with the weight plate, the collar 5 has a resistance effect on the weight plate; simultaneously, the outer surface of the collar is designed to match the outer surface of the weight plate, further enhancing the resistance effect on the weight plate.

The limiting assembly comprises multiple limiting spheres 3, and the inner wall of the first sleeve 1 is radially provided with multiple channels for the sliding of the corresponding limiting spheres 3, the channels penetrate through both the inner and outer walls of the first sleeve 1.

The limiting spheres 3 protrude partially outside the channels; after the barbell bar is inserted into the first sleeve 1, the limiting spheres 3 are respectively contact with the barbell bar and the inner wall of the second sleeve 2.

One end of the first sleeve 1 with a smaller inner diameter is aligned with the barbell bar, the barbell bar is inserted inward; by manipulating the second sleeve 2 to slide relative to the first sleeve 1, so that the limiting spheres 3 are retracted into the channels, allowing continuous insertion of the barbell bar inward; after inserted into the specified position, with the first sleeve against the barbell bar, and after the barbell bar is fully inserted, due to the first sleeve gradually decreases in inner and outer diameters from its first end to its second end, that is, inner and outer walls of the first sleeve 1 are inclined surfaces, the limiting spheres 3 will be pressed simultaneously by the barbell bar and the inner wall of the second sleeve 2, the limiting spheres 3 will exert a counterforce on the barbell bar to further secure the barbell bar in place; when disassembly is required, the inner wall of the second sleeve 2 only needs to be slid along the tapered surface of the outer wall of the first sleeve 1 towards one end of a smaller outer diameter of the first sleeve 1, this will increase the distances between the limiting spheres 3 and an outer wall of the second sleeve 2, thereby releasing the pressure on the barbell bar and allowing for disassembly.

It is worth noting that the limiting spheres 3 can also be connected within the channels via springs; when compressed by the barbell bar, the limiting spheres 3 exert pressure on the barbell bar through the counteraction of the spring force, achieving an anti-slip effect.

A hand-held portion 4 is arranged on the outer circumference of the first end of the first sleeve 1.

In practical operation, the hand-held portion 4 can be held by hand to perform subsequent operations to achieve the object of labor saving.

It is worth noting that the first sleeve 1 is fixedly connected with the hand-held portion 4, and the fixing method can be various.

The second sleeve 2 is connected correspondingly to the hand-held portion 4.

Specifically, the second sleeve 2 and the hand-held portion 4 can be connected by a link, a screw connection, etc., and the forms can be various.

The collar 5 is installed on a first end of the first sleeve 1, the collar 5 is axially elastically connected to the first sleeve 1.

After gripping the hand-held portion 4, you can firmly hold the collar 5, and then you can pull the first sleeve 1 up and down; after use, the elastic force will reset the first sleeve 1.

It is worth noting that the collar 5 and the second sleeve 2 are fixedly connected.

Figure 2:
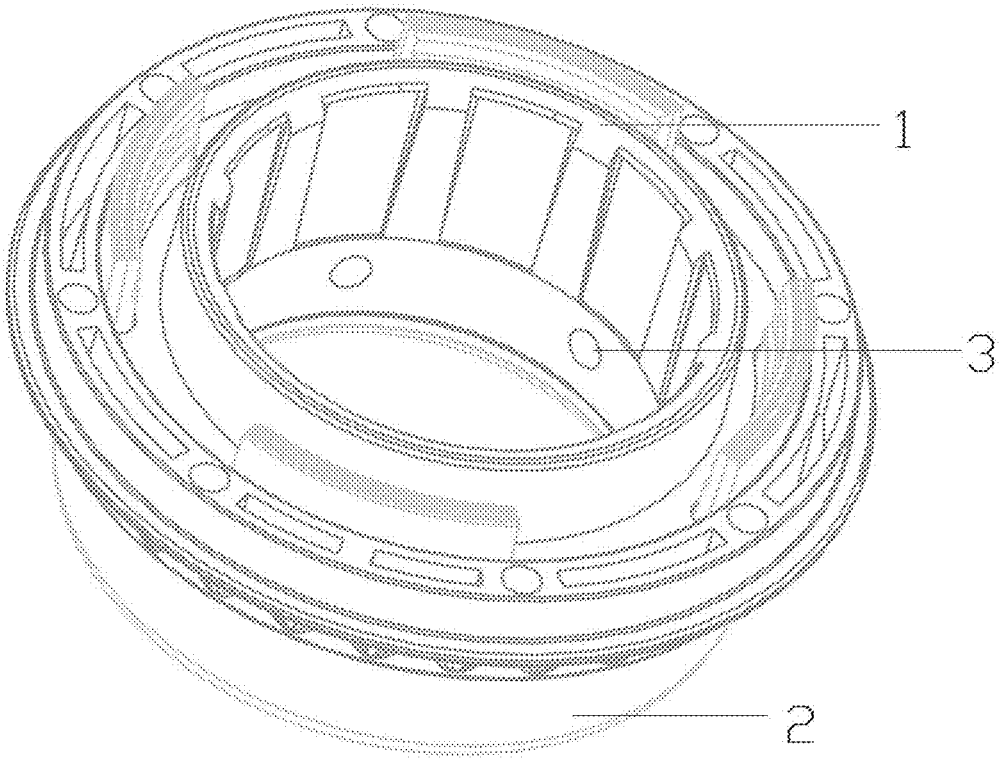
FIG. 2 is a schematic diagram of the structure of the barbell clamp (without the collar) in the embodiment of the invention.
Figure 3:
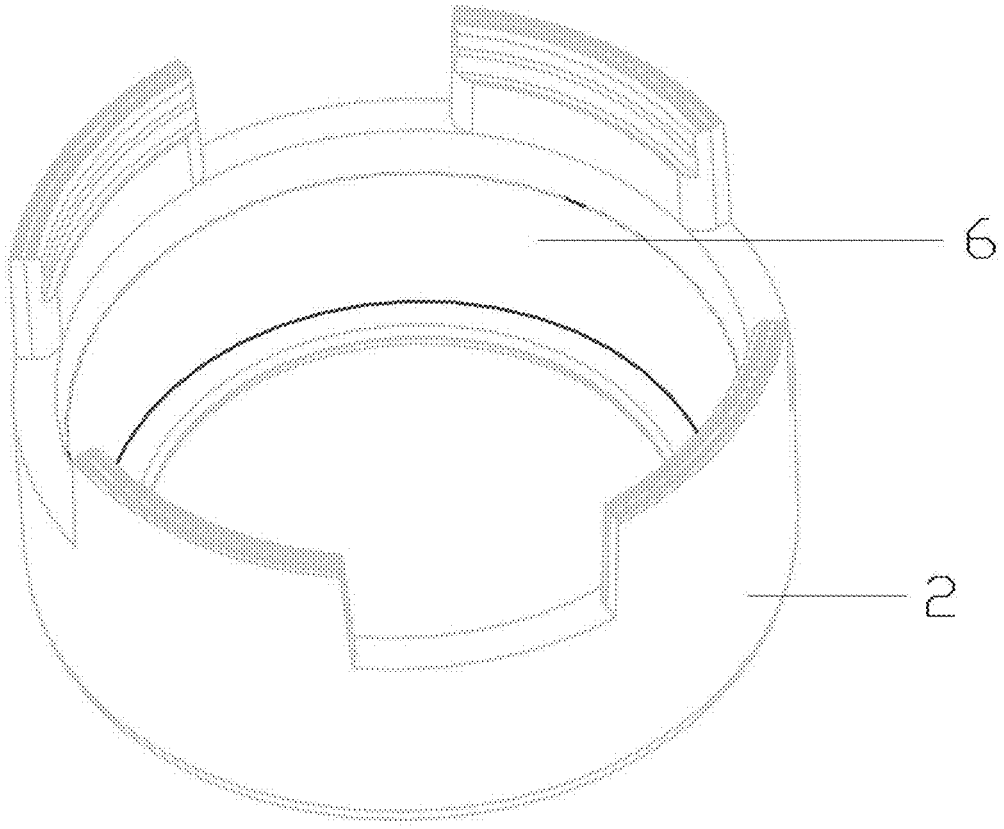
FIG. 3 is a schematic diagram of the structure of the first sleeve in the embodiment of the invention.

In addition, combined with FIG. 2, as another improvement of the invention, a groove is arranged on the inner wall of the second sleeve 2, and an annular sheet 6 is embedded in the groove, so as to increase the strength of the second sleeve.

It is worth noting that the annular sheet 6 can be made of, but not limited to, plastic, steel, etc.

The above is only a preferred embodiment of the invention. It should be noted that, for those of ordinary skills in this technical field, several improvements and modifications can be made without departing from the principle of the invention, and these improvements and modifications should also be regarded as the protection scope of the invention.

The invention claimed is:

1. A barbell clamp, comprising a first sleeve that is sleeved on one end of a barbell bar and a second sleeve that is sleeved outside the first sleeve, the first sleeve gradually decreases in inner and outer diameters from its first end to its second end, an outer wall of the first sleeve is an inclined surface, an inner wall of the second sleeve is in contact with the inclined surface, a limiting assembly is installed on an inner wall of the first sleeve, the limiting assembly limits the position after the barbell bar is properly inserted into the first sleeve, a collar is fixedly mounted on an outer end of the first sleeve, an outer surface of the collar is matched with an outer surface of a weight plate.

2. The barbell clamp of claim 1, wherein the limiting assembly comprises multiple limiting spheres, and the inner wall of the first sleeve is radially provided with multiple channels for the sliding of the corresponding limiting spheres, the channels penetrate through both the inner and outer walls of the first sleeve.

3. The barbell clamp of claim 2, wherein the limiting spheres protrude partially outside the channels; after the barbell bar is inserted into the first sleeve, the limiting spheres are respectively contact with the barbell bar and the inner wall of the second sleeve.

4. The barbell clamp of claim 3, wherein a hand-held portion is arranged on the outer circumference of the first end of the first sleeve.

5. The barbell clamp of claim 4, wherein the second sleeve is connected correspondingly to the hand-held portion.

* * * * *